US008333335B2

(12) United States Patent
Xu et al.

(10) Patent No.: US 8,333,335 B2
(45) Date of Patent: Dec. 18, 2012

(54) SHOWER HEAD

(75) Inventors: Feng Xu, Guangdong Pr. (CN); Mengfeng Cheng, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 434 days.

(21) Appl. No.: 12/639,098

(22) Filed: Dec. 16, 2009

(65) Prior Publication Data

US 2011/0139904 A1 Jun. 16, 2011

(51) Int. Cl.
*B05B 1/14* (2006.01)
*F23D 14/68* (2006.01)

(52) U.S. Cl. ..... 239/553.3; 239/555; 239/587.3; 4/678; 4/903

(58) Field of Classification Search ..... 239/548, 239/553, 553.3, 553.5, 555, 558, 587, 559, 239/567, 589, 586; 4/675, 678, 903, 615
See application file for complete search history.

(56) References Cited

U.S. PATENT DOCUMENTS

| | | | | |
|---|---|---|---|---|
| 6,382,531 | B1 * | 5/2002 | Tracy | 239/548 |
| 6,641,057 | B2 * | 11/2003 | Thomas et al. | 239/104 |
| 7,111,798 | B2 * | 9/2006 | Thomas et al. | 239/548 |
| 2007/0246577 | A1 * | 10/2007 | Leber | 239/589 |
| 2011/0000983 | A1 * | 1/2011 | Chang | 239/567 |

* cited by examiner

*Primary Examiner* — Len Tran
*Assistant Examiner* — Justin Jonaitis

(57) ABSTRACT

A shower head comprises an upper watering set including a tube having a channel formed therein, a first disc including a bottom wall, and a connection defined between the tube and the first disc and including an arcuate internal wall formed therein, between the internal wall and the bottom wall being defined plural radial passages; a lower watering set connected to the upper watering set and including a top surface disposed on a top end thereof and having a conical guiding peg inserted to the receiving chamber, the guiding peg including an arcuate periphery extending downward and outward to correspond to the internal wall; plural distances between the top surface and peripheral fences of the passages being equivalent to form a number of gaps so as to adjust flowing amounts in the passages individually; the top surface including a plurality of spouts relative to the passages to spray water flowers.

12 Claims, 9 Drawing Sheets

SHOWER HEAD

BACKGROUND OF THE INVENTION

1. Field of the Invention

The present invention relates to a shower head that can provide strong water flowers equally.

2. Description of the Prior Art

Conventional shower head is installed to a feeding pipe in a bath room or a shower room to spray water flower, and includes an upper disc with an inlet, a lower disc connected to a lower side of the upper disc and having a plurality of outlets, and includes a hollow flowing space defined between the upper and the lower discs so that water flows to the flowing space from the inlet of the upper disc and then sprays out of the outlets of the lower disc. However, such a conventional shower head has some defects. For example, the hollow flowing space can not limit water to flow in a certain manner, thereby lowering watering energy and pressure, and the spraying amounts from the outlets are not equal, especially when the flowing amount is less then 2.5 GPM. In addition, the spraying head does not face downward and vertically but being limited at a certain tilted angle to further lower watering energy and pressure. If a shower head with the same structure but in a larger size is designed, the hollow flowing space makes the lower disc have a deformation because of water pressure, causing water leak.

The CN Pat. No. ZL 200580000294.7 discloses a shower head including a channel formed between the upper and the lower discs so that watering tunnels and unwatering tunnels are separated apart, hence water from the upper disc is guided to the outlets of the lower disc to decrease water pressure.

Nevertheless, such watering tunnels include a plurality of radial passages and annular paths, therefore when water from the inlet of the upper disc flows to the radial passages and is guided to the annular paths, a curved water guiding lowers watering energy and pressure to decrease spraying amounts from the outlets of the lower disc, causing unequal watering amount. Besides, when the flowing amount is less then 2.5 GPM and the shower head is set at a tilted angle, the unequal watering amount becomes serious.

The present invention has arisen to mitigate and/or obviate the afore-described disadvantages.

SUMMARY OF THE INVENTION

The primary object of the present invention is to provide a shower head which is capable of overcoming the shortcomings of the conventional shower head.

A shower head in accordance with a preferred embodiment of the present invention comprises:

an upper watering set including a tube, a first disc, and a connection defined between the tube and the first disc; the tube including a channel formed therein; the first disc including a bottom wall disposed on a bottom end thereof; the connection including an arcuate internal wall formed therein and extending downward and radially; between the internal wall of the connection and the bottom wall of the first disc being defined a plurality of radial passages, each passage including two peripheral fences mounted on two sides thereof respectively, and two opposite peripheral fences of each two abutting passages connecting with each other by their inner ends; the peripheral fences include vertical planes formed on inner ends thereof individually to define a receiving chamber;

a lower watering set connected to a lower side of the upper watering set and including a top surface disposed on a top end thereof, the top surface including a conical guiding peg inserted to the receiving chamber, and the guiding peg including an arcuate periphery extending downward and outward to correspond to the internal wall of the connection; between the top surface and the two peripheral fences forms a gap so as to adjust a flow in the passages; the top surface including a plurality of spouts relative to the passages to spray water flowers;

wherein the two peripheral fences of two sides of the each passage are parallel to each other.

DETAILED DESCRIPTION OF THE PREFERRED EMBODIMENTS

Figure 1:
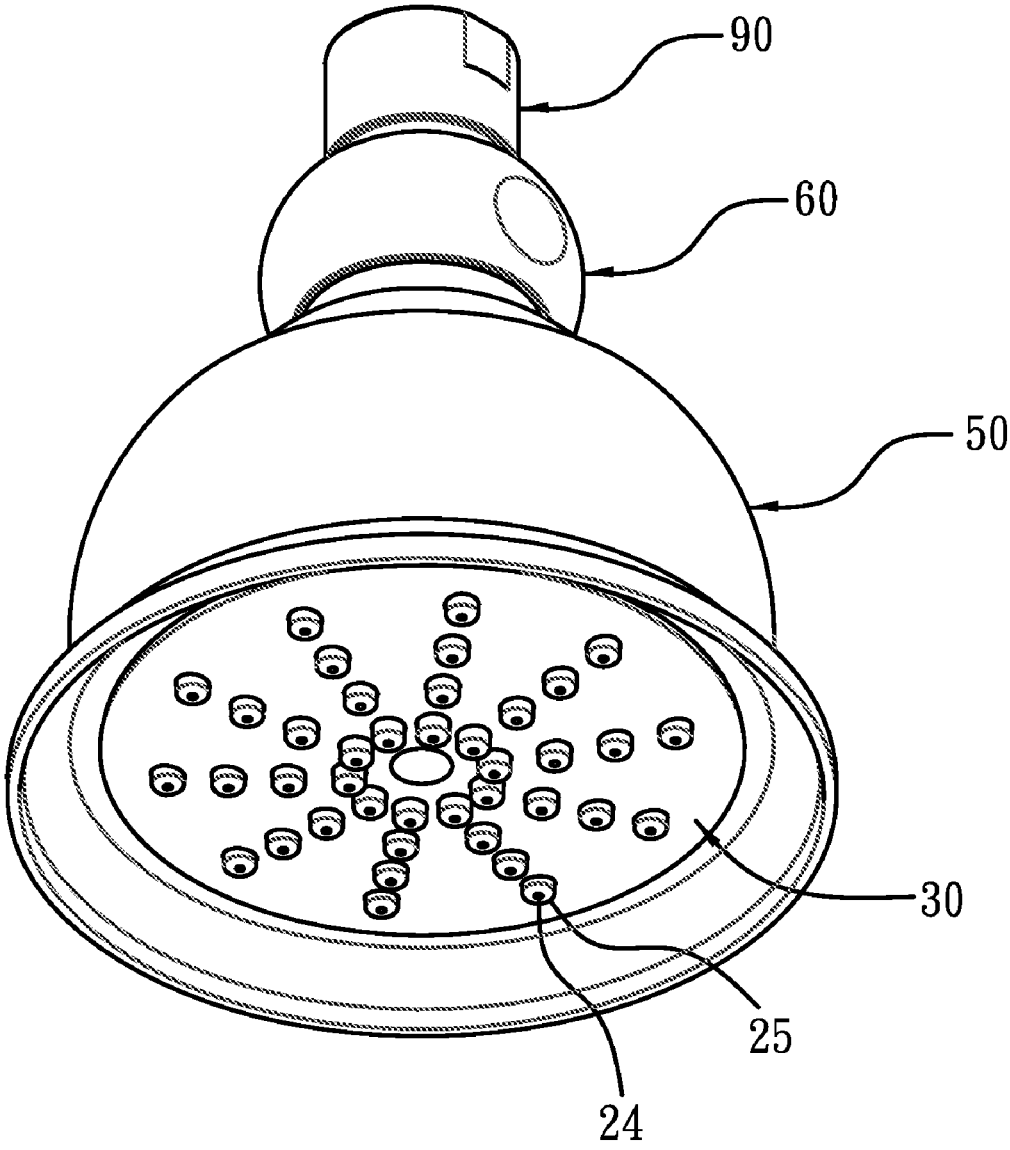
FIG. 1 is a perspective view showing the assembly of a shower head in accordance with a preferred embodiment of the present invention.
Figure 2:
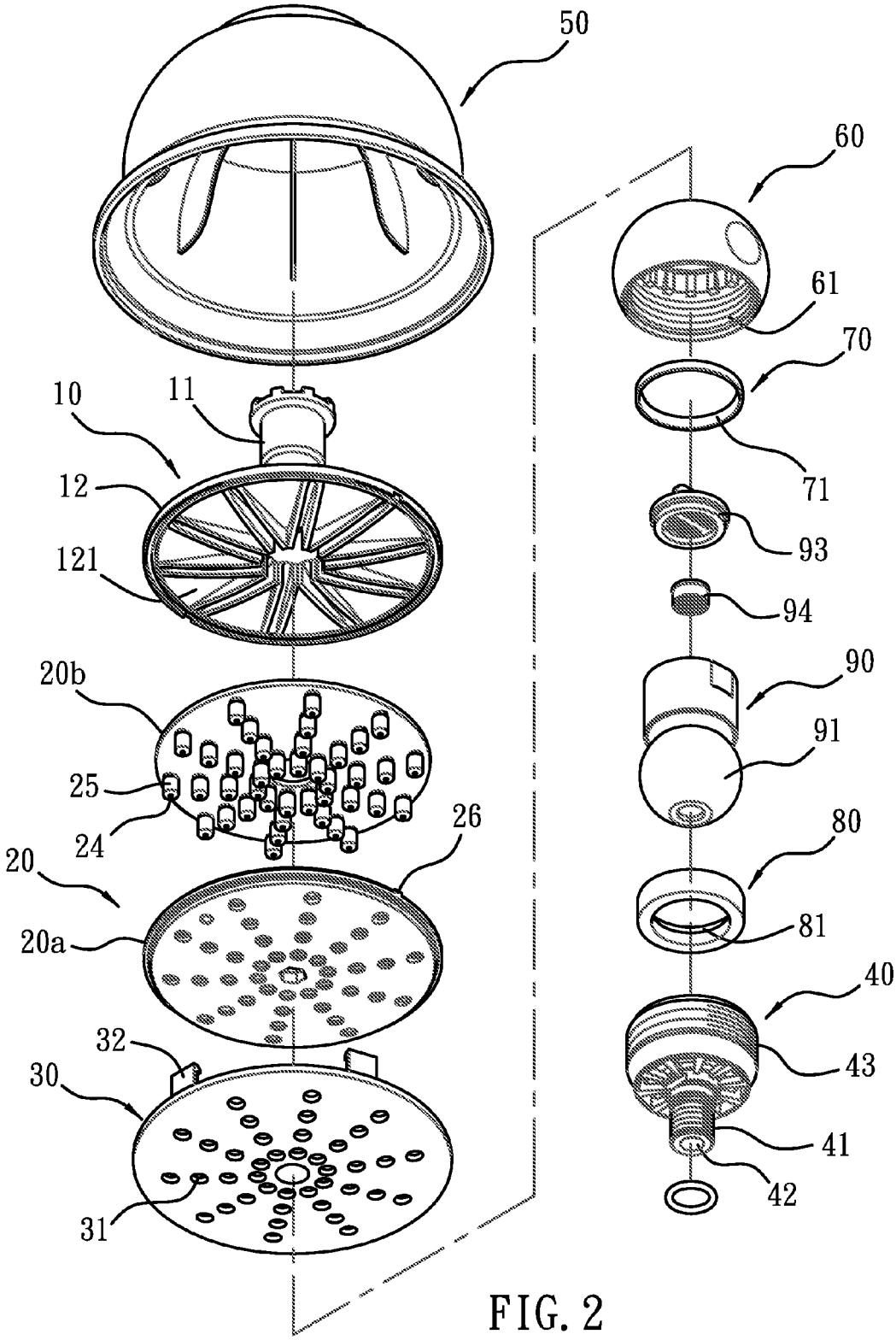
FIG. 2 is a perspective view showing the exploded components of the shower head in accordance with the preferred embodiment of the present invention.
Figure 3:
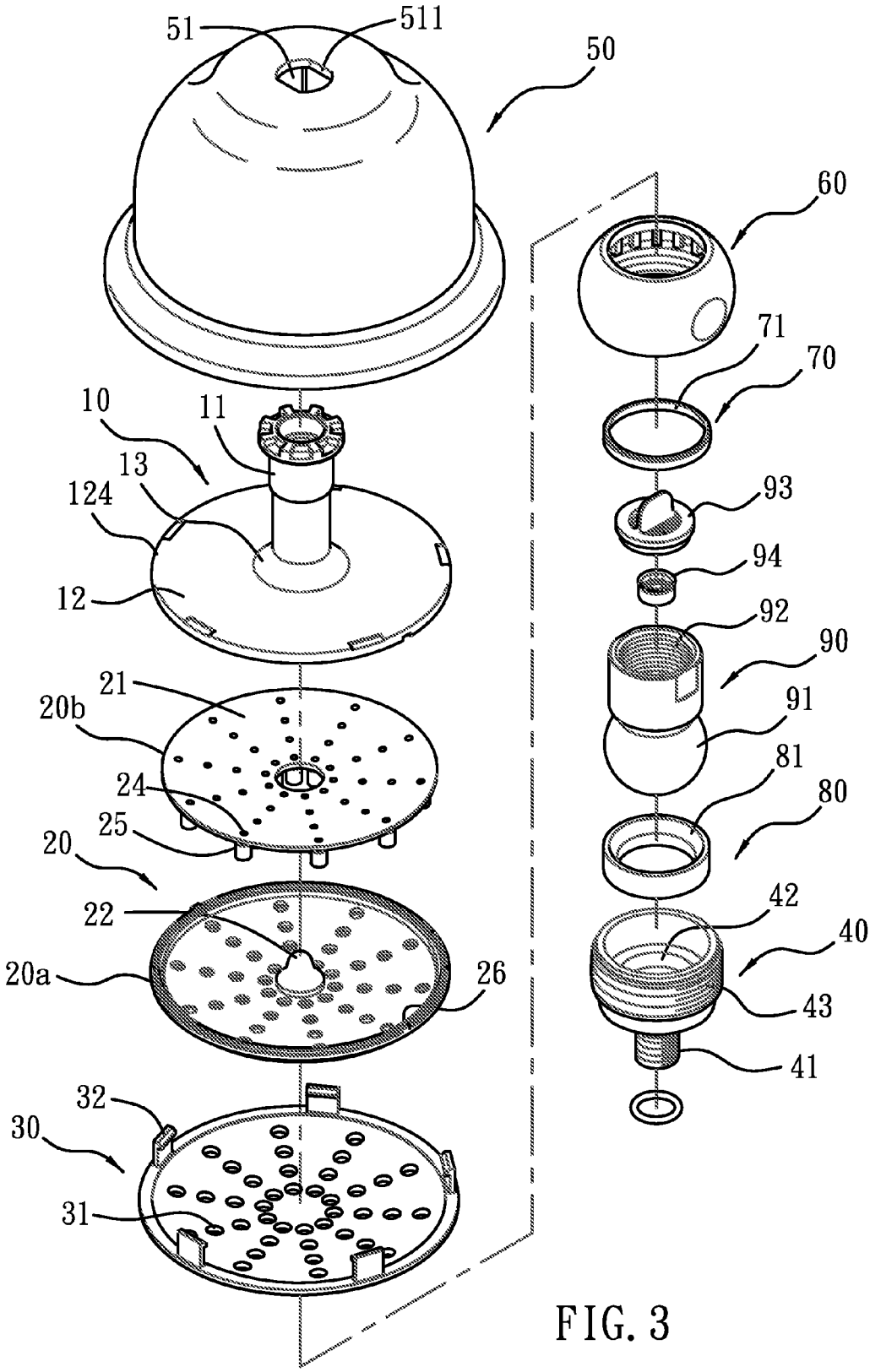
FIG. 3 is another perspective view showing the exploded components of the shower head in accordance with the preferred embodiment of the present invention.
Figure 4:
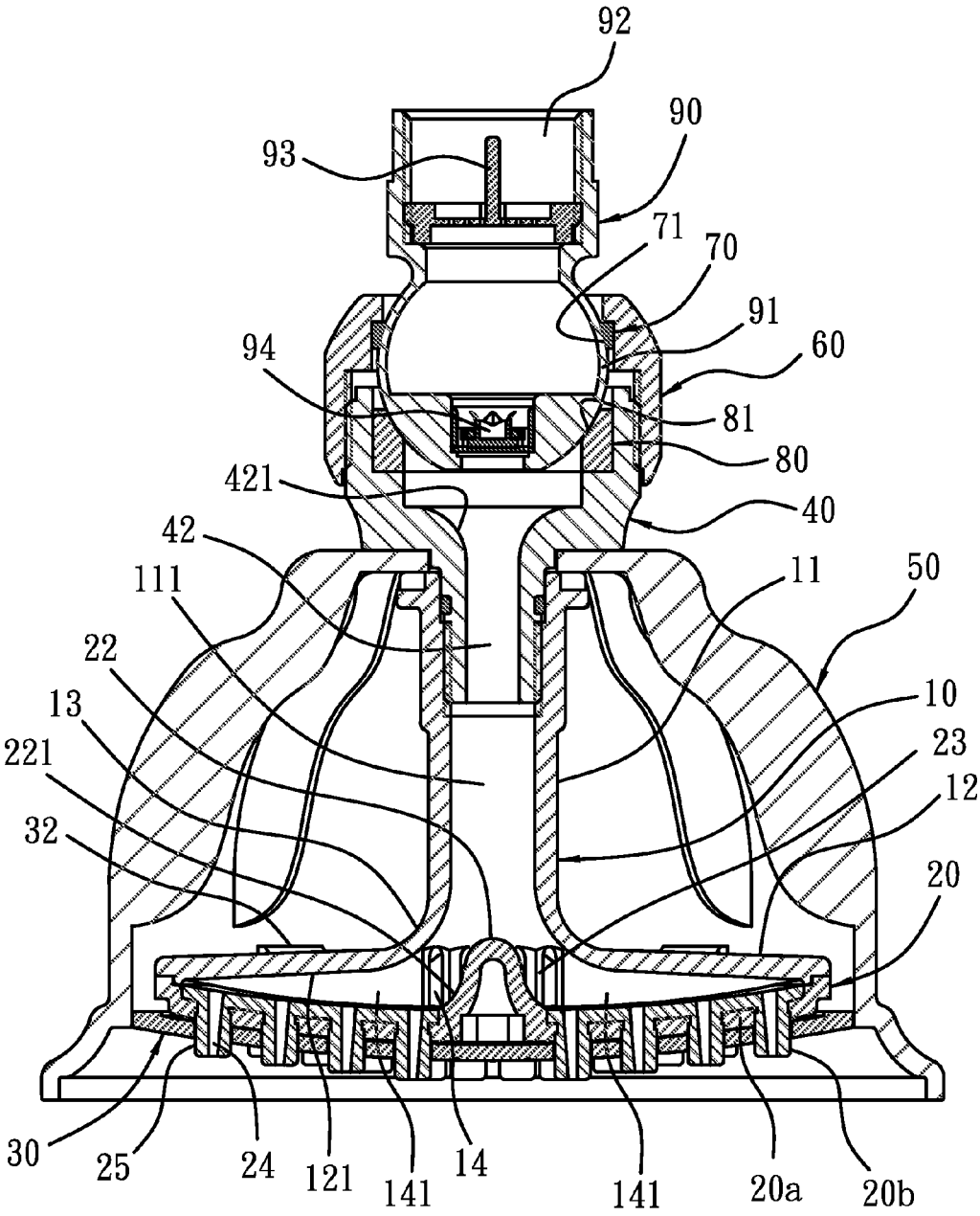
FIG. 4 is a cross sectional view showing the assembly of the shower head in accordance with the preferred embodiment of the present invention.
Figure 5:
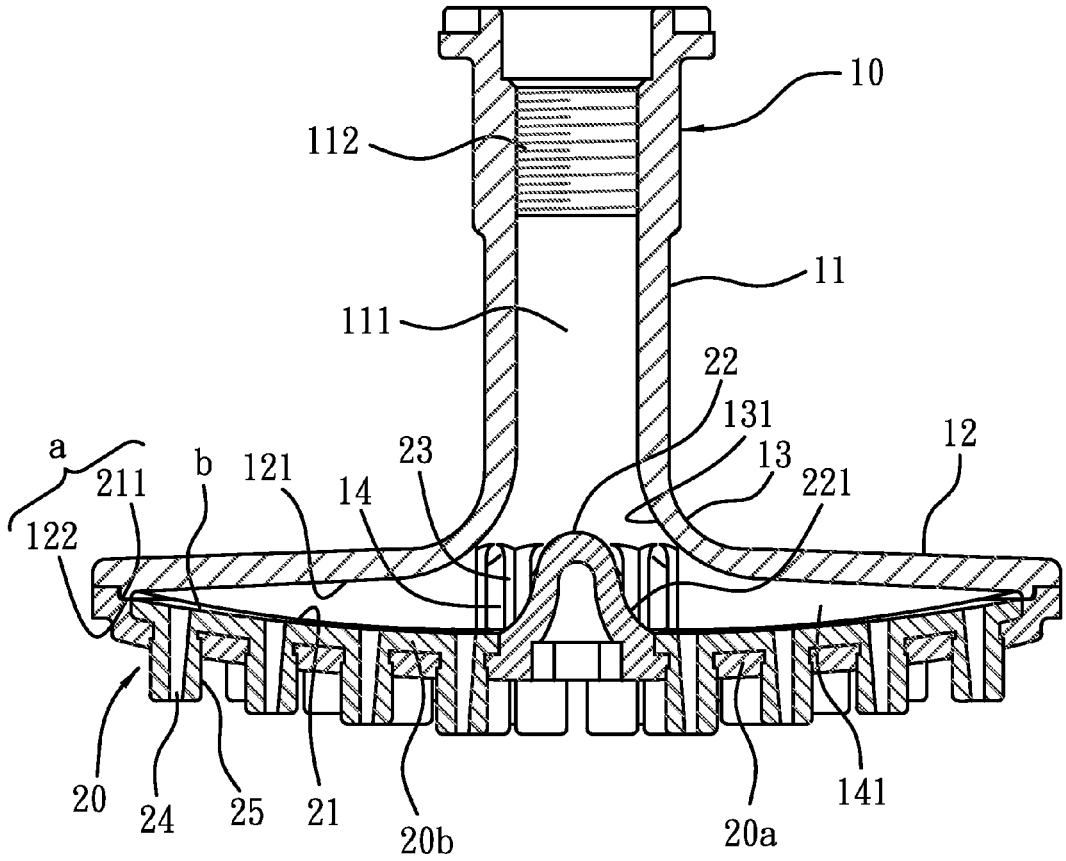
FIG. 5 is a cross sectional view showing the assembly of an upper watering head and a lower watering head of the shower head in accordance with the preferred embodiment of the present invention.
Figure 6:
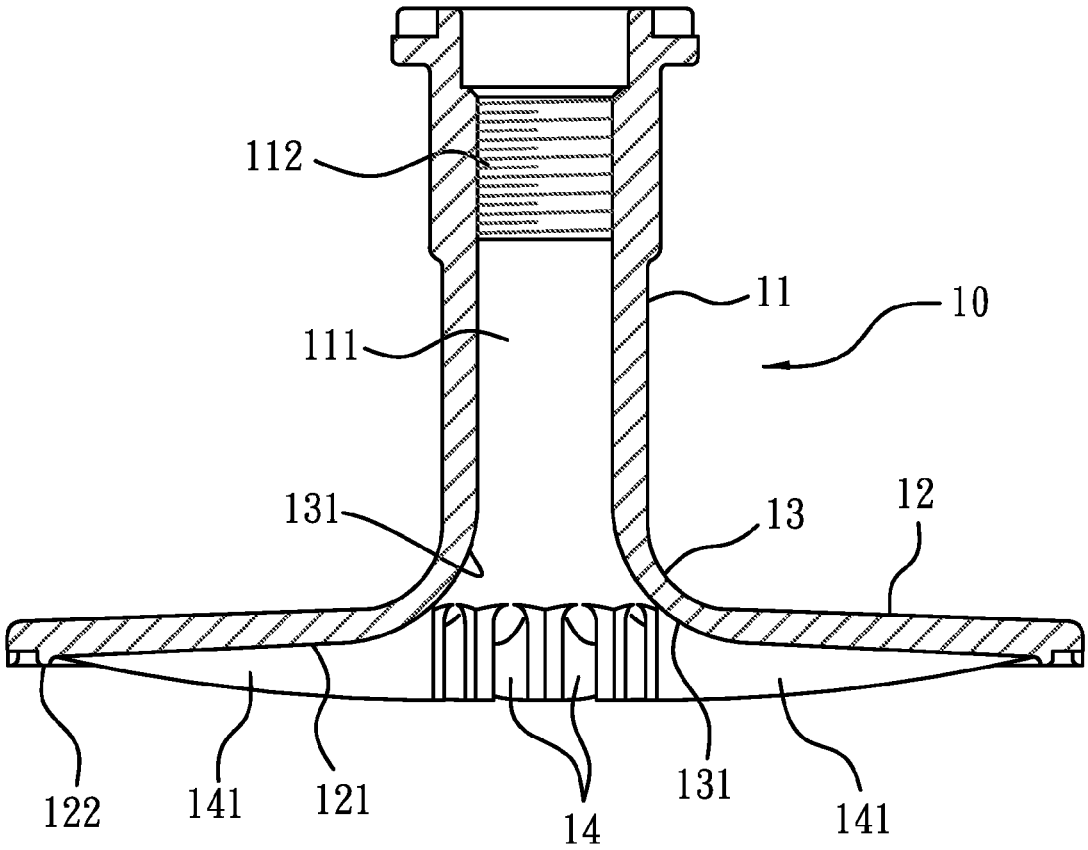
FIG. 6 is a cross sectional view showing the assembly of the upper watering member of the shower head in accordance with the preferred embodiment of the present invention.
Figure 7:
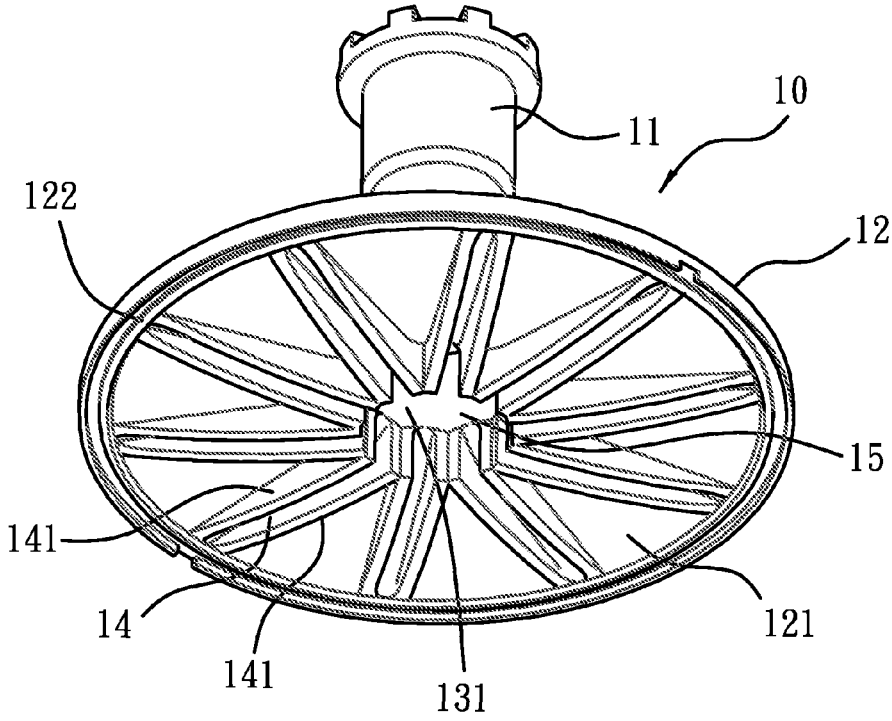
FIG. 7 is a perspective view showing the assembly of the upper watering member of the shower head in accordance with the preferred embodiment of the present invention.
Figure 8:
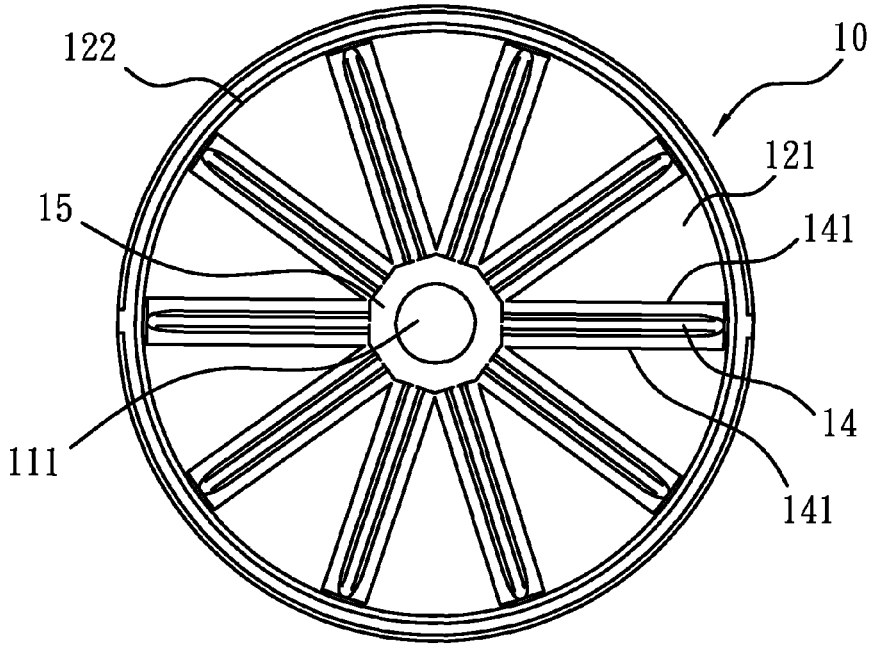
FIG. 8 is a bottom plan view showing the assembly of the upper watering member of the shower head in accordance with the preferred embodiment of the present invention.

The present invention will be clearer from the following description when viewed together with the accompanying drawings, which show, for purpose of illustrations only, the preferred embodiment in accordance with the present invention.

Referring to FIGS. 1-4, a shower head according to a preferred embodiment of the present invention comprises an upper watering set 10, a lower watering set 20, a lid 30, a seat 40, a housing 50, a covering member 60, an upper pad 70, a lower pad 80, and a spherical connector 90.

As shown in FIGS. 5-8, the upper watering set 10 includes a tube 11, a first disc 12, and a connection 13 defined between the tube 11 and the first disc 12. The tube 11 includes a channel 111 formed therein to flow water, and the channel 111 has inner threads 112 arranged on a top end thereof. The first disc 12 includes a bottom wall 121 disposed on a bottom end thereof and includes an abutting rim 122 extending downward from the bottom end thereof. The connection 13 includes an arcuate internal wall 131 formed therein and extending downward and radially to connect with the bottom wall 121 of the first disc 12. Between the internal wall 131 of the connection 13 and the abutting rim 122 of the first disc 12 are defined a plurality of radial passages 14, each spaced apart from each other. In this embodiment, there are ten passages 14 arranged between the internal wall 131 of the connection 13 and the abutting rim 122 of the first disc 12. The passage 14 includes two peripheral fences 141 mounted on two sides thereof respectively and parallel to each other, and two opposite peripheral fences 141 of each two abutting passages 14 connect with each other by their inner ends. It is to be noted that the peripheral fence 141 rises from inside to outside and has an arc-shaped profile as viewed from a plane side so that a bottom end of the each passage 14 extends outward obliquely., thus obtaining a decreased depth. Moreover, an outer end of the passage 14 is arcuate, such that the passage 14 is viewed like an archway from an inner side, and a cross sectional area of the passage 14 to flow water is decreased from inside to outside.

The peripheral fences 141 include vertical planes formed on inner ends thereof individually to define a circular receiving chamber 15. The first disc 12 includes a number of limiting slots 123 arranged on a side surface thereof and a plurality of engaging grooves 124 fixed around a rim of a top end of thereof.

Figure 9:
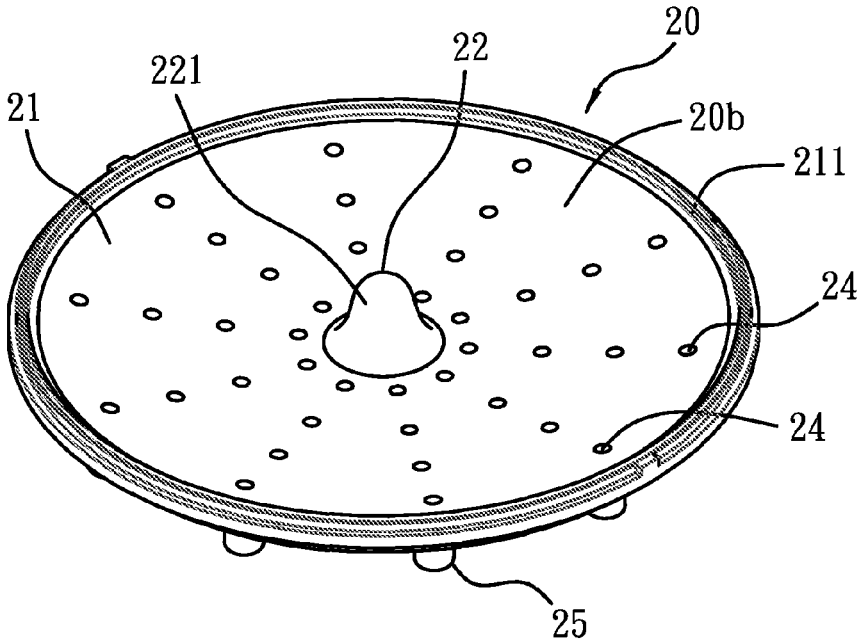
FIG. 9 is a perspective view showing the assembly of the lower watering member of the shower head in accordance with the preferred embodiment of the present invention.
Figure 10:
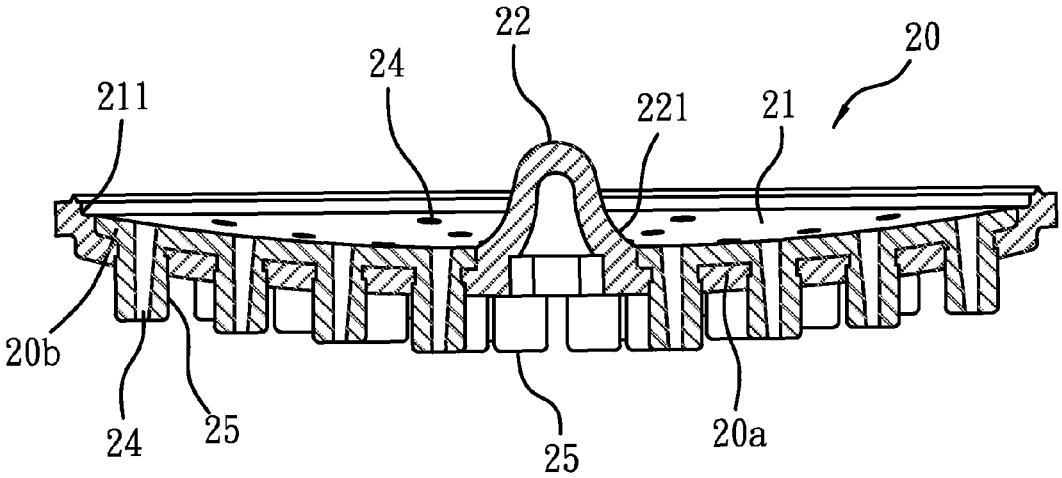
FIG. 10 is a cross sectional view showing the assembly of the lower watering member of the shower head in accordance with the preferred embodiment of the present invention.
Figure 11:
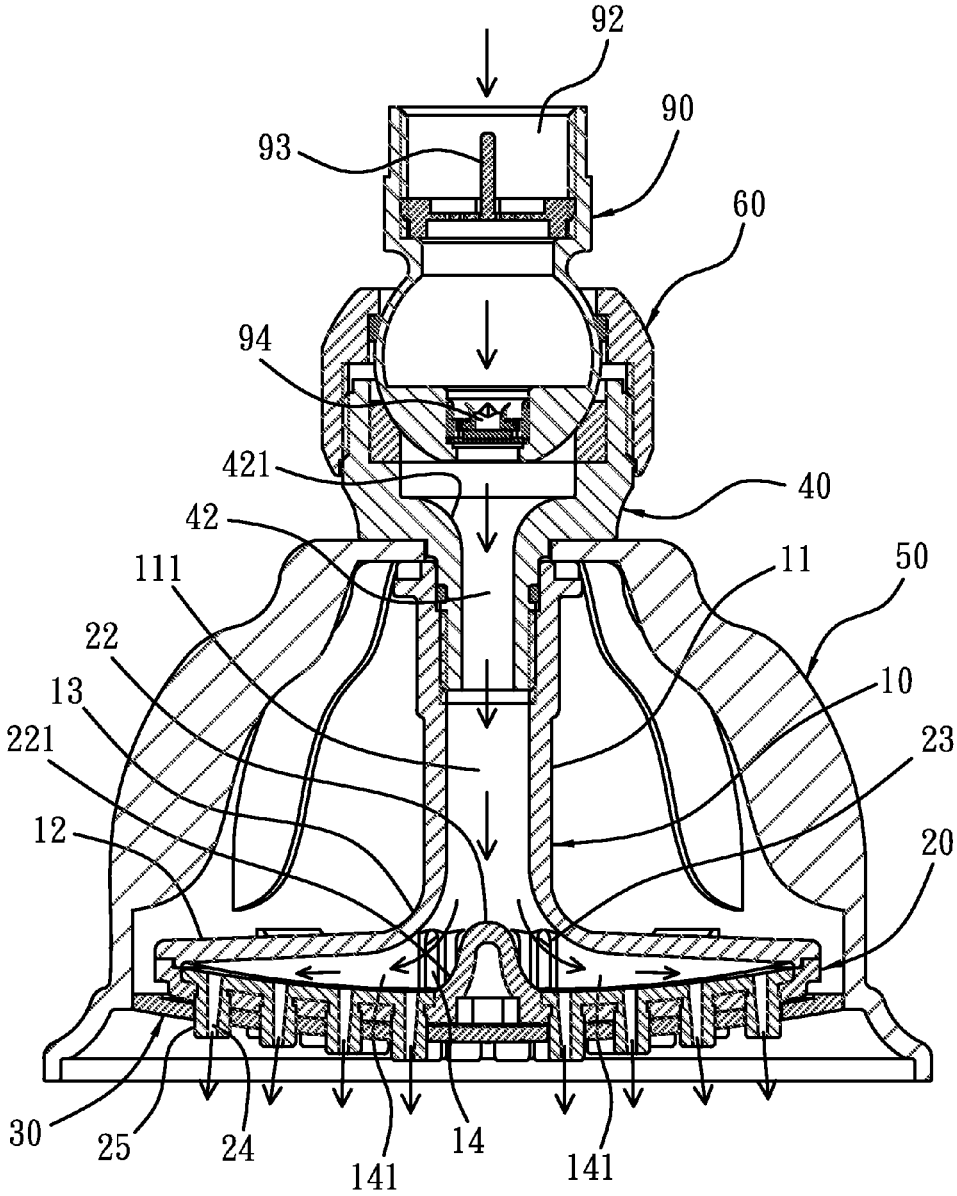
FIG. 11 is a cross sectional view showing the operation of the shower head in accordance with the preferred embodiment of the present invention.

Referring to FIGS. 9-11, the lower watering set 20 is formed in a disk shape to connect to a lower side of the upper watering set 10, and includes a concave top surface 21 disposed on a top end thereof, the top surface 21 includes a conical guiding peg 22 extending upward from a central portion thereof to be inserted to the receiving chamber 15 of the upper watering set 10, and the guiding peg 22 includes an arcuate periphery 221 extending downward and outward to correspond to the internal wall 131 of the connection 13 so that after water from the channel 111 contacts with a top end of the guiding peg 22, it is guided to a tunnel 23 to further flow downward and outward, wherein the guiding peg 22 also allows to limit a cross sectional area of the water which flows through the receiving chamber 15, thus accelerating flowing speed as water flows through the tunnel 23.

The lower watering set 20 includes an annular biasing rib 211 disposed on a top surface of an outer rim thereof to engage with the abutting rim 122 of the bottom wall 121, generating a contacting portion a. Thereby, a certain area between the upper and the lower watering sets 10, 20 in the contacting portion a is formed a cavity to flow water.

Between the top surface 21 and the two peripheral fences 141 forms a gap b so that water from the channel 111 flows through the tunnel 23 to be separated to further flow into the passages 14, hence the flow and the pressure are adjusted by the gap b to flow separated waters equally.

The top surface 21 of the lower watering set 20 includes a plurality of spouts 24 to spray water flowers. In this embodiment, there are four spouts 24 formed in a linear arrangement.

The lower watering set 20 includes a base 20*a* and a second disc 20*b* integrally injection formed with each other, the second disc 20*b* includes the top surface 21 disposed on a top end thereof and located between the guiding peg 22 and the biasing rib 211, and the top surface 21 includes a plurality of nozzles 25 fixed thereon to arrange the spouts 24 by using their internal arteries, and a distal end of each nozzle 25 extends downward from a bottom end of the base 20*a* so that water sprays out of the spouts 24 of the nozzles 25 via the passages 14 to provide strong water flowers equally.

The lower watering set 20 also includes a number of defining blocks 26 mounted around a peripheral side thereof and extending outward to be retained in the limiting slots 123 of the upper watering set 10 securely.

The lid 30 abuts against a bottom end of the lower watering set 20 and includes a plurality of holes 31 fixed thereon to extend the nozzles 25 outward, and includes a number of retainers 32 secured on a top end thereof to be retained in the engaging grooves 124 fixedly so that the lower watering set 20 is defined between the upper watering set 10 and the lid 30.

The seat 40 includes first outer threads 41 formed on a bottom end thereof to screw with the inner threads 112 of the tube 11 of the upper watering set 10, and includes a path 42 fixed therein to communicate with the channel 111 of the tube 11, and the path 42 includes a downward decreased mouth 421 arranged on a top end thereof to concentrate water and enhance pressure, thereby accelerating flowing speed. The seat 40 also includes second outer threads 43 disposed on a top end thereof.

The housing 50 is formed in a bell shape and includes an orifice 51 mounted on a top end thereof, the orifice 51 includes an annular edge 511 provided therein to position the housing 50 between the seat 40 and the lower watering set 20. In this embodiment, the bottom end of the housing 50 extends over bottom ends of the nozzles 25 so that the upper watering set 10, the lower watering set 20, and the lid 30 are received in the housing 50, and a lower side of an inner wall of the housing 50 biases against a side surface of the lid 30.

The covering member 60 includes inner threads 61 mounted thereon to screw with the second outer threads 43 of the seat 40.

The upper pad 70 is located at a top end of the covering member 60 and includes a concave first internal fringe 71 formed on an inner side thereof.

The lower pad 80 is located at the top end of the seat 40 and includes a concave second internal fringe 81 secured on an inner side thereof.

The spherical connector 90 includes a spherical portion 91 disposed on a bottom end thereof to be defined between the first internal fringe 71 of the upper pad 70 and the second internal fringe 81 of the lower pad 80 so that the seat 40 rotates on the spherical connector 90 freely, and the spherical connector 90 also includes a passageway 92 mounted therein to communicate with the path 42 of the seat 40, and a top end of the spherical connector 90 couples with a feeding pipe to supply water.

The passageway 92 of the spherical connector 90 includes a filtering member 93 and a water saver 94 disposed on a top and a bottom ends thereof respectively, wherein the filtering member 93 is used to filter impurities, and the water saver 94 serves to adjust flowing amount based on water pressure. When the water pressure is increased, the flowing amount in the passageway 92 is decreased to lower water amount, and when the water pressure is decreased, the flowing amount in the passageway 92 is increased to enhance water amount.

The shower head of the present invention is connected to a feeding pipe in a bath room or a shower room so that when a water lever is turned on, water flows into the passageway 92 of the spherical connector 90 along the feeding pipe. As shown in FIG. 11, the water flows to the path 42 of the seat 40 via the filtering member 93 and the water saver 94, and when the water flows across the decreased mouth 421, it is strengthened to increase flowing speed and then flows to the channel 111 of the upper watering set 10. Thereafter, the water further flows to the tunnel 23 to be distributed to flow into the passages 14, hence the water sprays out of the spouts 24 of the nozzles 25, generating water flowers.

It is to be noted that when water flows through the tunnel 23, because a cross sectional area of water is limited by the guiding peg 22, water is guided downward and radially to increase flowing speed. Furthermore, the tunnel 23 is designed in an annular manner to change flowing direction from an axial direction into a radial direction so as to lower the loss of watering energy.

As water flows through the passages 14, due to the passages 14 are extended outward and downward and their bottom ends are formed in a concave arc shape, outward and downward flowing speed of the water is enhanced so that water flows to the spouts 24 of the nozzles 25 with stronger watering energy.

When water flows to the passages 14, some waters are in communication with each other by using the gaps b to adjust flowing amount automatically. It is to be noted that when the shower head supplies water at a certain tilted angle, e.g., the spouts 24 do not face downward and vertically, the water between the passages 14 allow to be adjusted easily.

In addition, even though flowing amount is less then 2.5 GPM of standard amount, the spraying effect remains efficient.

While we have shown and described various embodiments in accordance with the present invention, it is clear to those skilled in the art that further embodiments may be made without departing from the scope of the present invention.

What is claimed is:

1. A shower head comprising:

an upper watering set including a tube, a first disc, and a connection defined between the tube and the first disc;

the tube including a channel formed therein;

the first disc including a bottom wall disposed on a bottom end thereof;

the connection including an arcuate internal wall formed therein and extending downward and radially;

between the internal wall of the connection and the bottom wall of the first disc being defined a plurality of radial passages, each passage including two peripheral fences mounted on two sides thereof respectively, and two opposite peripheral fences of each two abutting passages connecting with each other by their inner ends;

the two peripheral fences include vertical planes formed on inner ends thereof individually to define a receiving chamber;

a lower watering set connected to a lower side of the upper watering set and including a top surface disposed on a top end thereof, the top surface including a conical guiding peg inserted to the receiving chamber, and the guiding peg including an arcuate periphery extending downward and outward to correspond to the internal wall of the connection; between the top surface and the two peripheral fences forms a gap so as to adjust a flow in the passages; the top surface including a plurality of spouts relative to the passages to spray water flowers;

wherein the two peripheral fences of two sides of the each passage are parallel to each other;

wherein the two abutting passages extend from a middle section of the arcuate internal wall of the connection to the bottom wall of the first disc;

wherein the lower watering set includes a base and a second disc integrally injection formed with each other, the second disc includes the top surface disposed on the top end thereof and located between the guiding peg and a biasing rib, and the top surface includes a plurality of nozzles fixed thereon to arrange the spouts by using a plurality of internal arteries.

2. The shower head as claimed in claim 1, wherein a bottom end of the each passage extends outward obliquely.

3. The shower head as claimed in claim 1, wherein an outer end of the each passage is arcuate.

4. The shower head as claimed in claim 1, wherein a depth of the each passage becomes decreased from inside to outside.

5. The shower head as claimed in claim 1, wherein a cross sectional area of the each passage to flow water is decreased from inside to outside.

6. The shower head as claimed in claim 1, wherein a distal end of each nozzle extends downward from a bottom end of the base.

7. The shower head as claimed in claim 6 further comprising a lid abutting against a bottom end of the lower watering set and including a plurality of holes fixed thereon to extend the nozzles outward.

8. The shower head as claimed in claim 1 further comprising a seat including first outer threads formed on a bottom end thereof to screw with inner threads of the tube of the upper watering set, and including a path fixed therein to communicate with the channel of the tube.

9. The shower head as claimed in claim 8, wherein the path includes a downward decreased mouth arranged on a top end thereof.

10. The shower head as claimed in claim 8 further comprising a housing including an orifice mounted on a top end thereof, the orifice including an annular edge provided therein to position the housing between the seat and the lower watering set; the upper watering set and the lower watering set being received in the housing.

11. The shower head as claimed in claim 8 further comprising a covering member, an upper pad, a lower pad, and a spherical connector, wherein the covering member screws with a top end of the seat; and the upper and the lower pads are positioned in the covering member and the seat respectively; the spherical connector also includes a passageway mounted therein and a spherical portion disposed on a bottom end thereof to be defined between a first internal fringe of the upper pad and a second internal fringe of the lower pad to be rotated freely, thus adjusting spraying angles of the spouts.

12. The shower head as claimed in claim 11 further comprising a filtering member and a water saver disposed on a top and a bottom ends thereof respectively.

* * * * *